US006726403B1

(12) United States Patent
Kriticos

(10) Patent No.: US 6,726,403 B1
(45) Date of Patent: Apr. 27, 2004

(54) DEVICE AND METHOD FOR FORMING WAVES

(76) Inventor: Stephen Con Kriticos, 143 Behrens Road, Caboolture Queensland 4510 (AU)

( * ) Notice: Subject to any disclaimer, the term of this patent is extended or adjusted under 35 U.S.C. 154(b) by 0 days.

(21) Appl. No.: 10/048,902

(22) PCT Filed: Aug. 1, 2000

(86) PCT No.: PCT/AU00/00907

§ 371 (c)(1),
(2), (4) Date: Jun. 21, 2002

(87) PCT Pub. No.: WO01/09463

PCT Pub. Date: Feb. 8, 2001

(30) Foreign Application Priority Data

Aug. 2, 1999 (AU) ..... PQ 1958

(51) Int. Cl.[7] ..... A47K 3/10; E02B 3/00
(52) U.S. Cl. ..... 405/79; 4/491; 472/128
(58) Field of Search ..... 405/79; 4/491; 472/128

(56) References Cited

U.S. PATENT DOCUMENTS

| | | | | | |
|---|---|---|---|---|---|
| 5,171,101 | A | * | 12/1992 | Sauerbier et al. | 405/79 |
| 5,564,859 | A | * | 10/1996 | Lochtefeld | 405/79 |
| 5,899,633 | A | * | 5/1999 | Lochtefeld | 405/79 |
| 5,899,634 | A | | 5/1999 | Lochtefeld | |
| 6,019,547 | A | | 2/2000 | Hill | |
| 6,336,771 | B1 | * | 1/2002 | Hill | 405/79 |
| 6,375,578 | B1 | * | 4/2002 | Briggs | 472/128 |
| 6,491,589 | B1 | * | 12/2002 | Lochtefeld | 472/128 |

FOREIGN PATENT DOCUMENTS

| | | |
|---|---|---|
| WO | 9204087 | 3/1992 |

* cited by examiner

*Primary Examiner*—Robert E. Pezzuto
*Assistant Examiner*—Tara L. Mayo
(74) *Attorney, Agent, or Firm*—Collard & Roe, P.C.

(57) ABSTRACT

The present invention provides a wave simulating device comprising a surface which substantially conforms to the shape that a face of a predetermined natural ocean wave has at a predetermined instant, and fluid projecting means for projecting fluid from a position which either lies in the plane of the surface or beneath said plane, wherein the fluid projecting means is arranged to project fluid out of the surface to enable a person to surf over the surface.

The present invention also provides a method of simulating a predetermined natural ocean wave comprising the steps of:

a) providing a surface which substantially conforms to the shape that a face of a predetermined natural ocean wave has at a predetermined instant; and b) projecting fluid from a position which either lies in the plane of the surface or beneath said plane to project fluid out of the surface to enable a person to surf over the surface.

The present invention also provides a method of simulating surfing a predetermined natural ocean wave comprising the steps of:

a) providing a surface which substantially conforms to the shape that a face of a predetermined natural ocean wave has at a predetermined instant;

b) projecting fluid from a position which either lies in the plane of the surface or beneath said plane to project fluid out of the surface; and c) surfing over the surface on the fluid projected therefrom.

63 Claims, 6 Drawing Sheets

DEVICE AND METHOD FOR FORMING WAVES

CROSS REFERENCE TO RELATED APPLICATIONS

Applicant claims priority under 35 U.S.C. §119 of Australian Application No. PQ1958 filed Aug. 2, 1999. Applicant also claims priority under 35 U.S.C. §120 of PCT/AU00/00907 filed Aug. 1, 2000. The international application under PCT article 21(2) was published in English.

FIELD OF THE INVENTION

The present invention relates to wave forming devices, apparatus and methods.

BACKGROUND OF THE INVENTION

A number of wave forming devices and methods have been developed that simulate some forms of ocean waves. Only one of these devices and associated methods that are presently available produce a breaking as opposed to a rolling ocean wave. The device is produced under the trademark FLOWRIDER. Breaking ocean waves are waves which build in amplitude until the crest of the wave moves in the direction of motion of the wave at a greater speed than that with which the body of the wave is moving to result in the crest of the wave collapsing forwardly in front of the body of the wave. The crest of some breaking ocean waves meets the water in front of the body of the wave without affecting the stability of the wave, to result in a wave commonly referred to by surfers as a "pipeline".

Surfers, body boarders and body surfers typically like to surf on the face of a breaking ocean wave, which is typically a concave surface. In surfing on the face of a breaking ocean wave, surfers, body boarders, and body surfers initially move in a downward direction while the wave is moving forwardly and can either be carried along by the wave in such a position or perform manoeuvres on the wave by moving relative to the wave. For example, they can move (a) longitudinally along the wave, (b) upwardly, up the face of the wave, (c) downwardly, down the face of the wave, or (d) any combination of movements (a)–(c). The FLOWRIDER includes a curved surface which corresponds to the face of a breaking ocean wave. The radius of curvature of the curved surface progressively varies along the length of the curved surface of the FLOWRIDER. Water is pumped from a lower region of the curved surface, upwardly along the curved surface, so that the pumped water follows the curvature of the curved surface and, in regions along the length of the FLOWRIDER the water is directed back to the lower region to produce a flow pathway which simulates a "pipeline".

A surfer typically surfs the FLOWRIDER by entering the simulated wave at a lower region of the wave. The upwardly directed water carries the surfer to an upper region of a curved surface. A surfer can then maneuver their board and/or themselves to surf their way along the length of the FLOWRIDER.

However, because the FLOWRIDER relies solely on water being forced upwardly up the curved surface to simulate a breaking ocean wave the FLOWRIDER does not accurately simulate a breaking ocean wave. This is because the water is forced upwardly up the curved surface at a much greater flowrate than water which flows upwardly up the face of a breaking ocean wave as a result of the "suck" of a breaking ocean wave. When a surfer surfs a breaking ocean wave, the surfer's board bites into the face of the wave and hence displaces water from the wave. The "suck" of a breaking ocean wave which produces movement of water up the face of the wave causes the water which is displaced by the surf board to curl over the edge of the board which is biting into the wave. The water which curls over the edge of the surf board provides a downward force to the board to hold the board into the wave. The flowrate at which water is required to be pumped up the curved surface of the FLOWRIDER results in the water travelling at such a speed that it does not provide any downward force to the board and hence does not hold a surf board into the curved surface of the FLOWRIDER. A vacuum is therefore applied to the curved surface of the FLOWRIDER to help prevent a surfers board from skipping out of the wave. While the vacuum addresses the problem of a board skipping out of the wave it introduces two additional problems. Firefly, surfers cannot perform maneuvers on the FLOWRIDER as they can when surfing a breaking ocean wave. If a surfer leaves the curved surface of the FLOWRIDER to perform a maneuver they are drawn into the curved surface of the FLOWRIDER by the vacuum which prevents them from completing their maneuver as they would if performing the maneuver on a breaking ocean wave. Secondly, the vacuum can result in a surfer being injured when attempting a maneuver because they are drawn either back into the curved surface or over an upper region of the curved surface and onto either the ground which surrounds the FLOWRIDER or part of the structure which supports the curved surface of the FLOWRIDER.

It is therefore desirable to provide a device and/or apparatus and/or method which more closely simulates an ocean wave, thereby enabling surfers, body boarders and body surfers to surf, body board or body surf without having access to ocean waves.

SUMMARY OF THE INVENTION

According to a first aspect of the present invention there is provided a wave simulating device comprising a surface which substantially conforms to the shape that a face of a predetermined natural ocean wave has at a predetermined instant, and fluid projecting means for projecting fluid from a position which either lies in the plane of the surface or beneath said plane, wherein the fluid projecting means is arranged to project fluid out of the surface to enable a person to surf over the surface.

Said person may surf either with a planar object including a body board, surf board or the like or without the planar object in which case the person body surfs over the surface.

The fluid may be completely or predominantly liquid.

The fluid projecting means may comprise a plurality of nozzles which are adapted to project fluid out of the surface.

The projection capability of the nozzles may vary from one that is capable of producing a very narrow projection to one that produces a very broad or diffuse projection.

The location and spacing of the nozzles may be varied to produce different surfing conditions.

The wave forming device may include projection control means for controlling the projection of fluid from the fluid projecting means.

The projection control means may be arranged to control characteristics of the projected fluid including any one or more of the following characteristics:

(a) pressure of the fluid which is projected out of the surface;

(b) diffuseness of the fluid which-is projected out of the surface.

The fluid may include a substance such as a surfactant which is adapted to increase forces of attraction between the fluid and the surface.

The fluid may comprise a liquid/air mixture which is adapted to form a liquid/air cushion over the surface.

The projection control means may include detecting means for detecting location of the object or person on the surface to enable fluid to be projected out of a nozzle during the instant that a person or object passes over the nozzle.

Fluid may be projected out of the nozzle by opening said nozzle for a predetermined period of time.

The detecting means may comprise a sensor which is adapted to recognize an activating signal and subsequently activate the projection of fluid from a nozzle.

The activating signal may include movement of a person.

The activating signal may include a planar object including a body board, surf board or the like.

The activating signal may include activating means for emission of an activating signal, the activating means being arranged for attachment to a person, or object including a body board, surf board or the like.

The planar object may include activating means for emission of an activating signal.

The activating signal may include a material or coating which is attached to a bottom side of a planar object, to the skin of a person, or outside surface of a wetsuit worn by a person.

The sensor may include a proximity switch.

The proximity switch may include any one or more of the following proximity switches:

(a) ultra sonnic;

(b) Infra red;

(c) Metal detector including ferrous or nonferrous metal detector;

(d) Photo-electric.

The nozzles may be arranged to project fluid out of the surface at an angle which is not transverse with the surface nor substantially parallel with the surface.

The fluid projecting means may be arranged to increase the area of contact on a planar object or person surfing over the surface and subsequently decrease the pressure of the fluid which is required to act on said object or person to keep said object or person respectively spaced apart from said surface.

The shape of a predetermined region of the surface may change with the use of shape varying means from one predetermined instant to another predetermined instant to simulate the changes in shape of a face of a natural breaking ocean wave as it approaches the shoreline.

The shape of the entire surface may change from one predetermined instant to another predetermined instant.

The shape varying means may include hydraulics.

The shape of the surface may be continuously changed through a sequence of shapes, the sequence and/or the shapes which form the sequence being arranged to simulate a predetermined natural breaking ocean wave.

The shape varying means may be controlled by shape control means.

The projection control means and shape control means may be controlled and synchronized by overall control means to simulate a predetermined natural breaking ocean wave.

The surface may have a predetermined surface area.

A longitudinal length of the surface which corresponds to a longitudinal length of a predetermined natural breaking ocean wave may be a predetermined amount.

The surface area and/or longitudinal length of the surface may be arranged to change from one predetermined instant to another predetermined instant. The surface is preferably orinated so that a person surfing over the surface surfs in a downward direction, so that they are propelled over the surface by a reduction in their gravitational potential energy.

It is preferred that the shape of the surface and distance between the upper and lower extremeties of the surface, at a predetermined instant, varies so that a longitudinal axis of the surface extends generally downwardly.

The downward orientation of the surface simulates the "suck" of a natural breaking ocean wave which moves up the face of a natural breaking ocean wave as the wave moves in a forward direction. The "suck" carries a surfer upwardly, enabling them to subsequently move down the face of the wave and gather speed relative to the face of the wave. By increasing their speed relative to the face of a wave a surfer can perform manoeuvres on the face of the wave.

The surface is preferably also orientated so that a person surfing over the surface moves forward of their starting position, as they surf over the surface.

It is preferred that the shape of the surface and distance between the upper and lower extremeties of the surface, at a predetermined instant, varies so that a longitudinal axis of the surface extends generally forwardly.

The longitudinal axis of the surface may be gradually downwardly sloping.

The longitudinal axis of the surface is also preferably gradually forwardly sloping.

It is preferred that the surface is adapted to absorb impacts from objects and persons.

It is preferred that the surface is adapted to cushion the impact between an object and/or person and the surface.

The surface may be padded.

It is also preferred that the surface is flexible to enable the shape of the surface to be varied.

The surface may be formed of a material which is arranged to reduce or minimise friction between an object and/or person and said surface.

The surface may be formed of a material which is arranged to (a) reduce or minimise friction between an object and/or person and said surface; and (b) cushion an impact between and object and/or person and the surface.

The surface may be formed of vinyl and/or plastic or like material.

The surface may have a crest portion and a trough portion corresponding respectively to a crest and trough of a predetermined natural breaking a ocean wave.

The surface may be arranged to enable a person surfing over the surface to surf over regions of the surface that have characteristics including anyone or more of the following that differ from other regions of the surface:

(a) shape (b) distance between lower and upper extremeties of the surface. The crest portion may adjoin a take-off region from where a person would begin their descent down the surface towards the trough portion of the surface.

The take-off region may comprise a substantially horizontal surface which extends both rearwardly of the crest portion, away from the surface, and a predetermined amount along the longitudinal length of the surface.

The substantially horizontal surface may be integrally formed with the crest portion.

Access means may be provided for access to the substantially horizontal surface.

The access means may comprise steps which extend from a base region of the simulating device upwardly towards the substantially horizontal surface and adjoin thereto.

The access means may be integrally formed with the surface.

The access means may be integrally formed with the crest portion.

The substantially horizontal surface may extend along the longitudinal length of the surface.

A person may select where along the longitudinal length of the substantially horizontal surface they begin their descent so that they surf over the surface which suites their surfing ability.

For example, an experienced surfer may dismount the take-off region at a position along the longitudinal length of the take-off region which corresponds to a longitudinal segment of the surface having a crest portion which extends upwardly and forwardly. In such a situation the surfer would free fall for a short period of time before coming into contact with the surface. This would simulate a situation where a surfer surfing a natural breaking ocean wave positions himself/herself on top of the platform of the wave for a short period of time before moving off the platform and free falling down to the face of the wave.

The trough portion of the surface may extend into a pool portion having a predetermined depth of liquid for entry of a person after they have moved down the surface from the take-off region.

The depth of the pool portion may vary to correspond to regions of a predetermined natural breaking ocean wave where a surfer may need a greater or less depth of liquid to break their fall.

The trough portion of the surface preferably meets an upper surface of the liquid of the pool portion so that the upper surface of the liquid in the pool portion forms an extension of the trough portion of the surface to simulate a natural breaking ocean wave wherein the trough of the wave extends smoothly into the water level of the ocean.

Sheets of liquid may be projected upwardly and forwardly of the crest portion of the surface so as to simulate a natural breaking ocean wave commonly referred to as a pipeline or tube.

The sheets of liquid may include a predetermined volume percentage of fluid.

The upwardly projected sheets of liquid may be projected after a person begins to move down the surface.

Alternatively, the sheets of liquid may only be projected upwardly and forwardly of the crest portion in a region along the longitudinal length of the surface where a person surfing is positioned at any given instant so that the projected sheets of liquid follow a surfer along the longitudinal length of the surface.

Projection of the sheets of liquid may be controlled by sheet projection control means.

The sheet projection control means may include sheet projection detecting means for detecting location of the object or person on the surface so that a surfer enters and leaves regions corresponding to "pipes" or "tubes" of a predetermined natural breaking ocean wave as they surf along the longitudinal length of the surface.

The sheet projection detecting means may comprise a sheet projection sensor which is adapted to recognise a sheet projection activating signal and subsequently activate the projection of sheets of liquid. The sheet projection sensor may include a sheet projection proximity switch.

The sheet projection activating signal may comprise movement of a person and the sheet projection proximity switch may include anyone or the following switches:

(a) Ultra sonic;

(b) Infrared;

(c) Photo-electric.

The sheet projection activating signal may include a material or coating which is attached to a bottom side of a planar object, to the skin of a person, or outside surface of a wet suit worn by a person, and the proximity switch may include a ferrous or non-ferrous metal detector.

The sheets of liquid may be produced by other projecting means for projecting liquid in a direction which is both upward and forward of the crest portion.

The surface may have a plurality of crest and trough portions.

The other projecting means may include the same features defined above in relation to the projecting means.

The device may include support means for supporting the surface.

The device may include movement means for moving the surface substantially horizontally in a direction which is substantially normal to a longitudinal axis of the surface to simulate the movement of a predetermined natural breaking ocean wave as it approaches the shoreline.

The overall control means may also control the sheet projection control means and the movement means.

The overall control means may control the projection control means, the sheet projection control means, the shape control means and the movement means to simulate a rolling ocean wave.

The overall control means may control the projection control means, the sheet projection control means, the shape control means and the movement means to simulate a breaking ocean wave.

The overall control means may control the projection control means, the sheet projection control means, the shape control means and the movement means to simulate an ocean wave which is in transition from a rolling ocean wave to a breaking ocean wave.

The nozzles of the fluid projecting means and other projecting means may be connected to fluid pressurising means which is positioned beneath the surface and is arranged to maintain fluid pressure so that upon opening of the nozzles fluid is forced out of the nozzles and subsequently out of the surface.

The nozzles may be seated in a common reservoir which is pressurised by the fluid pressurising means.

Alternatively, the nozzles may connect to a pipe which in turn connects to the fluid pressurising means.

The pipe may include a feeder pipe which is positioned below the surface and is substantially aligned with the longitudinal axis of the surface, the nozzles being attached to the feeder pipe and the feeder pipe attaching to a pressurised pipe which connects the feeder pipe to the fluid pressurising means.

The feeder pipe may comprise a plurality of feeder pipes.

The feeder pipe and pressurised pipe may be integrally formed. opening of each nozzle for a predetermined period of time may be activated by a corresponding sensor.

Alternatively, each sensor may activate opening of at least two corresponding nozzles for a predetermined period of time wherein each such sensor is positioned in a predetermined region about the at least 2 corresponding nozzles so that an object or person passing over the surface in a downward direction passes over a sensor prior to passing over a nozzle which is activated by the sensor.

The sensors are preferably positioned either in the plane of the surface or beneath said plane and adapted to activate the projection of fluid from a corresponding nozzle while of a person or object is passing over the sensor.

A sensor may activate a corresponding nozzle which is located in a predetermined region about the sensor so that an object or person passing over the surface in an upward direction passes over a sensor prior to passing over a nozzle which is activated by the sensor.

It is preferred that each nozzle has associated detector means for detecting whether the planar object or person is either contacting the surface or very near thereto such that projection of water from the projecting means or other projecting means is prevented when the planar object or person is not either contacting the surface or very near thereto to prevent fluid being projected either past outer edges of the planar object or into a region of the person's body such as their face or, in particular, eyes which are not either contacting or very near to the surface.

The temperature of the fluid may be controlled.

According to a second aspect of the present invention there is provided a method of simulating a predetermined natural ocean wave comprising the steps of:

(a) providing a surface which substantially conforms to the shape that a face of a predetermined natural ocean wave has at a predetermined instant; and (b) projecting fluid from a position which either lies in the plane of the surface or beneath said plane to project fluid out of the surface to enable a person to surf over the surface.

According to a third aspect of the present invention there is provided a method of simulating surfing a predetermined natural ocean wave comprising the steps of:

(a) providing a surface which substantially conforms to the shape that a face of a predetermined natural ocean wave has at a predetermined instant;

(b) projecting fluid from a position which either lies in the plane of the surface or beneath said plane to project fluid out of the surface; and (c) surfing over the surface on the fluid projected therefrom.

The method may include using any of the above defined features of the ocean wave simulating device.

In the claims which follow and in the preceding summary of the invention, except where the context requires otherwise, due to express language or necessary implication, the words "comprising", "comprises" or "comprise" are used in the sense of "including"; that is the feature specified may be associated with further features in various embodiments of the invention.

BRIEF DESCRIPTION OF THE DRAWINGS

A preferred embodiment of the present invention will now be described, by way of example only, with reference to the accompanying drawings in which.

BEST MODE OF CARRYING OUT THE INVENTION

Figure 1:
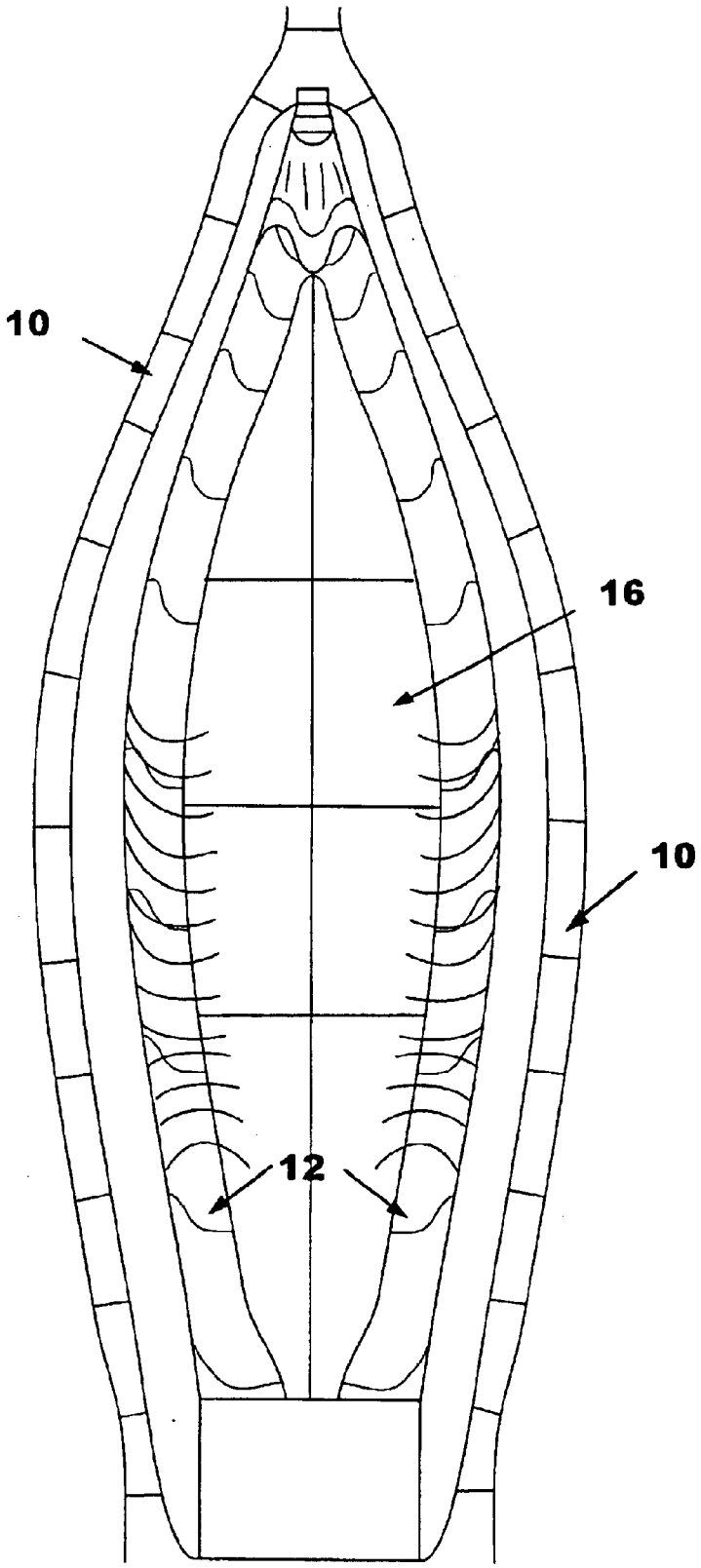
FIG. 1 is a plan view of one example of an ocean wave simulating device of the present invention.
Figure 2:
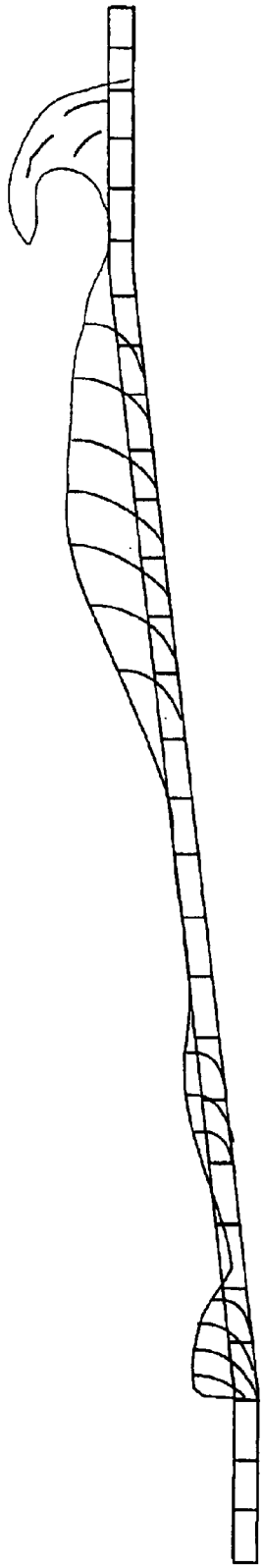
FIG. 2 is side elevation view of the ocean wave simulating device of FIG. 1.
Figure 3:
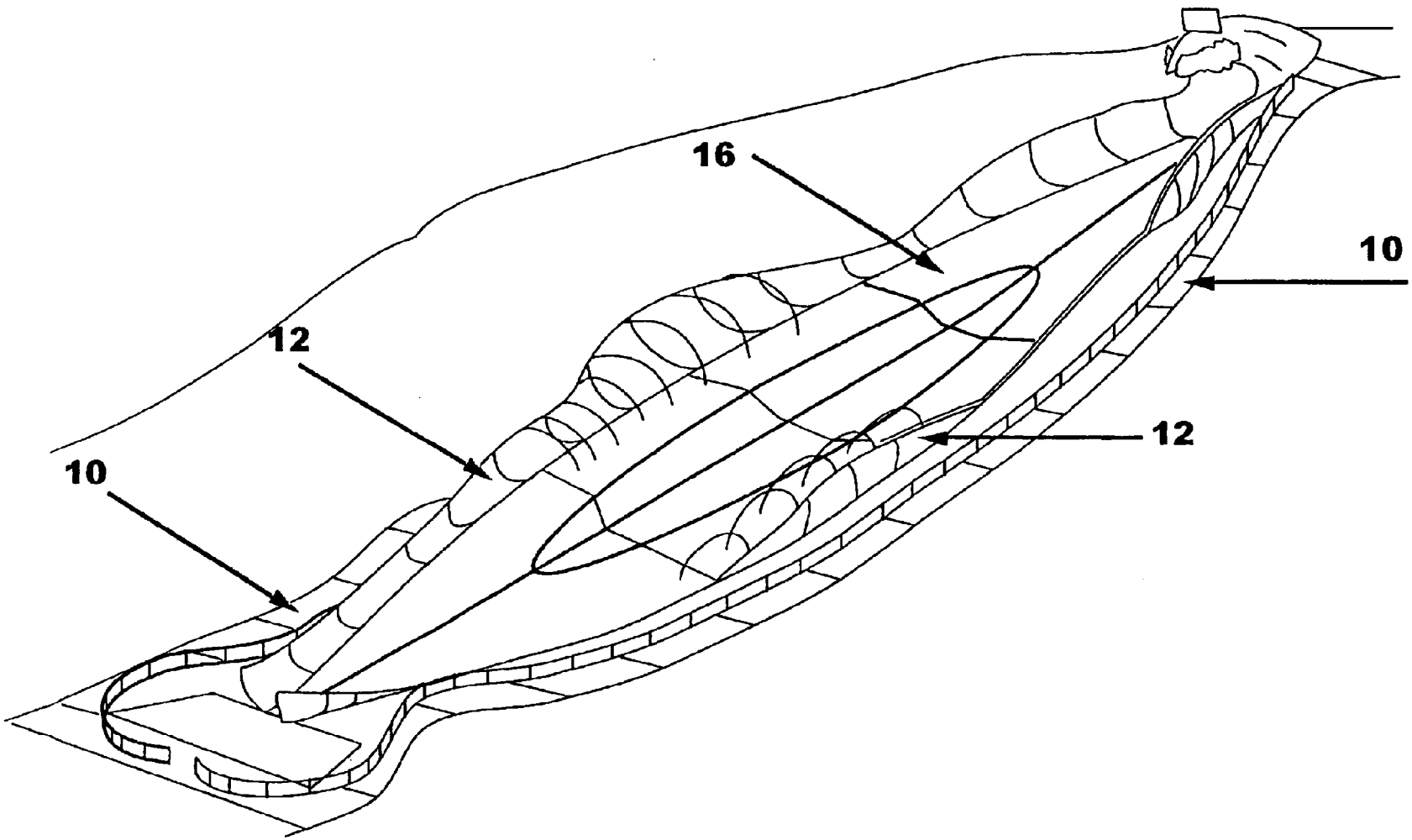
FIG. 3 is a perspective view of the ocean wave simulation device of FIGS. 1 and 2.
Figure 4:
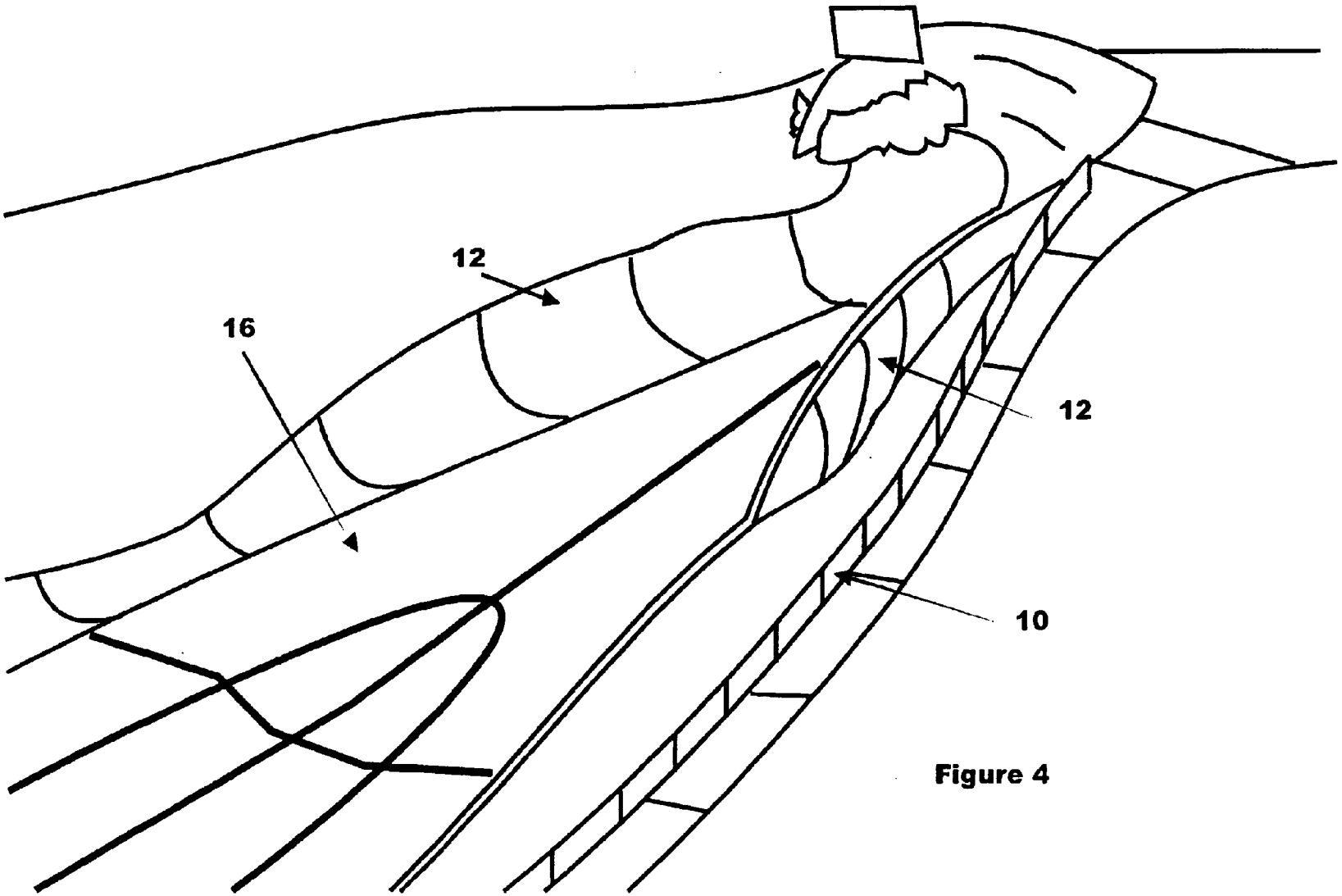
FIG. 4 is a detailed perspective view of one
Figure 5:
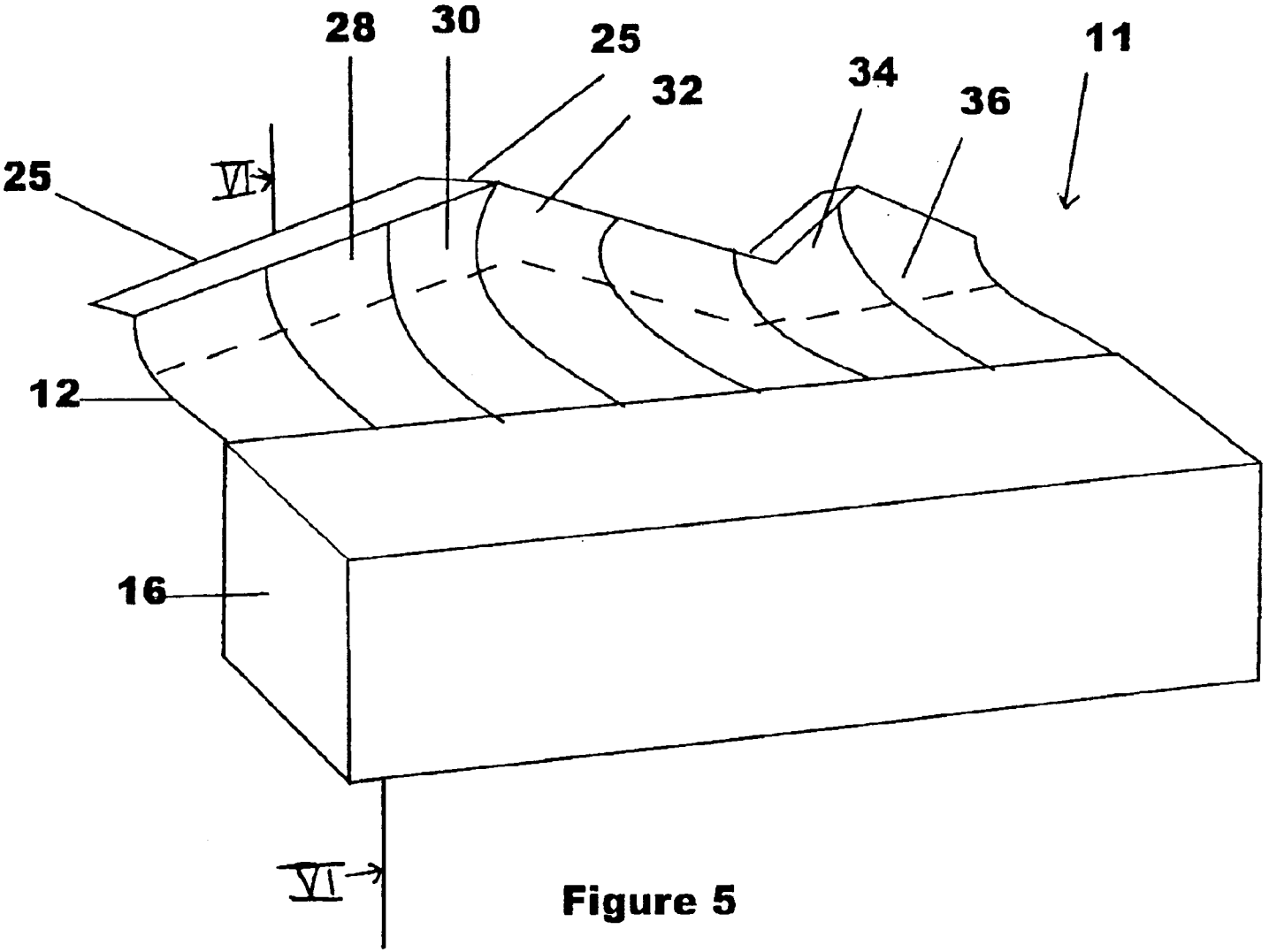
FIG. 5 is a diagrammatic view of a longitudinal segment of another example of an ocean wave simulating device of the present invention.
Figure 6:
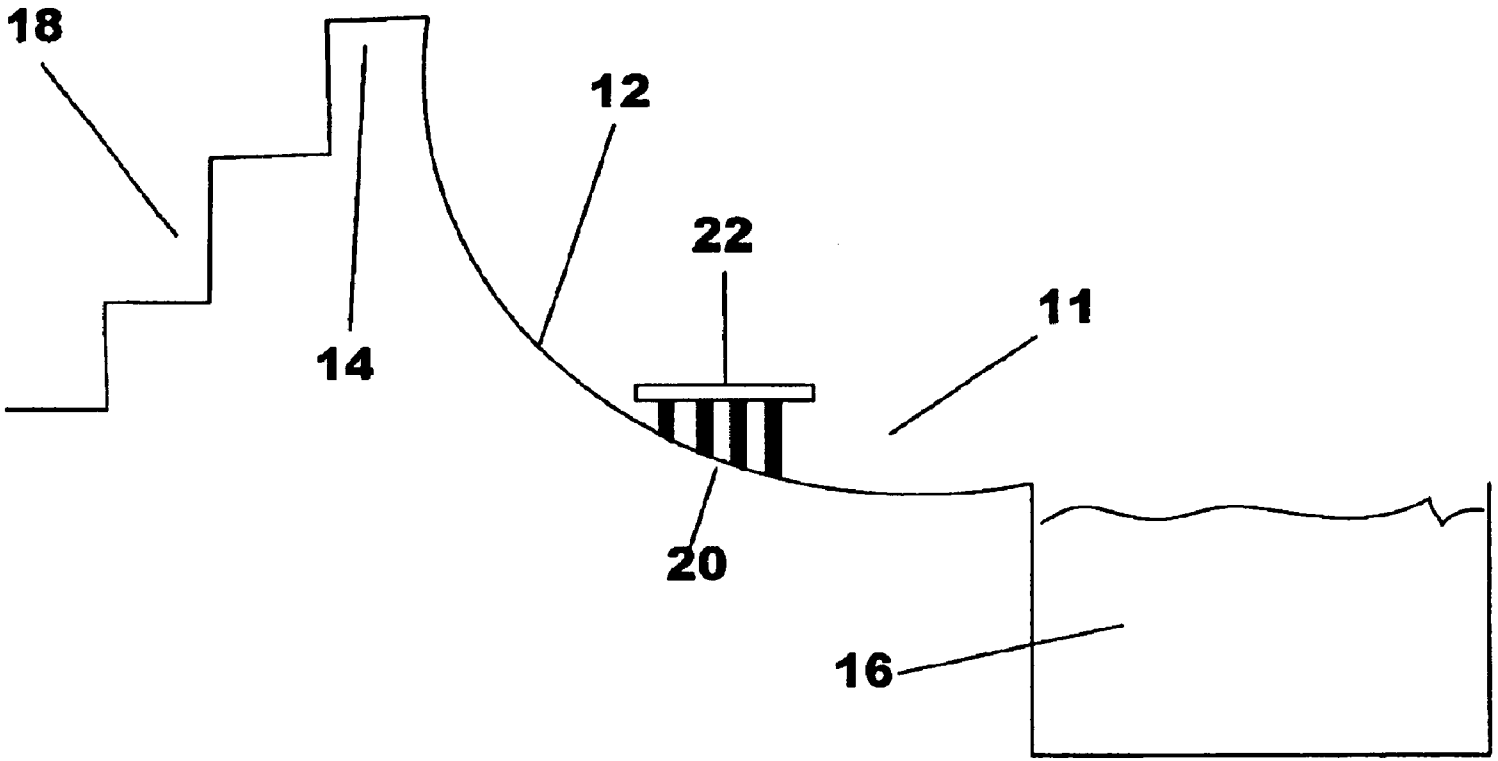
FIG. 6 shows an elevational view of a transverse section through line VI—VI of FIG. 5 which includes a side elevation of a surfboard which is part-way down the face of the ocean wave simulating device of FIG. 5.
Figure 7A:
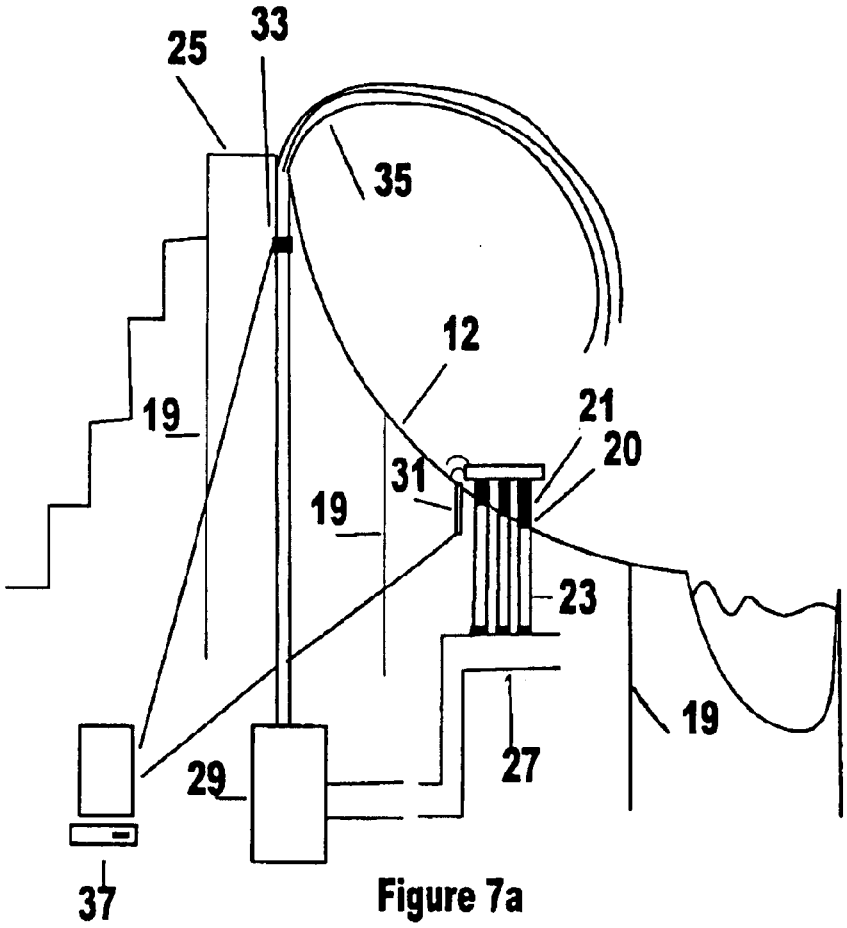
FIGS. 7*a* & 7*b* are detailed schematic sectional views of section A—A FIG. 5
Figure 7B:
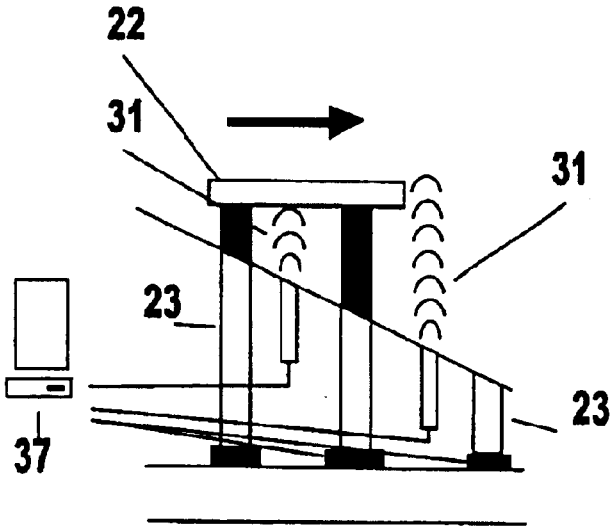

FIGS. 1–4 show one example of an artificial wave 10 while FIGS. 5–6 show another example of an artificial wave 11. For ease of reference, like features of artificial waves 10 and 11 are referred to by common reference numerals. Referring to FIGS. 1 and 3–6, the artificial waves 10 and 11 generally comprise a concave surface, one example of which is concave surface 12 which corresponds to the face of a breaking ocean wave, and a landing region, one example is a pool of fluid 16 which corresponds to water that lies in front of an ocean wave as the ocean wave moves in a forward direction toward the shoreline and typically builds in amplitude to form a breaking ocean wave. The artificial wave 11 of FIGS. 5 and 6 also has a takeoff zone 14 which extends from an upper region of the concave surface 12. The artificial wave 10 has a takeoff zone which is confined to certain sections along the length of the artificial wave 10; however, the takeoff zone of the artificial wave 10 is not shown in FIGS. 1–4. Referring to FIG. 6, mounting means, one example of which are stairs 18 extend upwardly from the ground to the take-off zone 14 of the artificial wave 11 and enable a person to climb to the take-off zone 14 where they can stand at the uppermost point of the concave surface 12. The artificial wave 10 also has a ramp or stairs corresponding to each takeoff zone (not shown) of the artificial wave 10 which enables surfers to access the artificial wave 10. However, the ramp or stairs of the artificial wave 10 are not shown in FIGS. 1–4.

Specific details of the artificial wave 11 are explained below with reference to FIGS. 5, 6, 7*a* and 7*b*. While such specific details not explained in relation to the artificial wave 10 of FIGS. 1–4, the artificial wave lo has features which correspond to features of the artificial wave 11; although, such features are not shown in FIGS. 1–4 and are therefore not explained in relation to the artificial wave 10. The concave surface 12 is supported by supports 19 and has a plurality of holes 20 through which pressurized fluid 21 is forced. The fluid 21 is forced through holes so that it projects upwardly and out of the concave surface 12. Projection of the fluid 21 is forced through the holes so that it projects upwardly and out of the concave surface 12. Projection of the fluid 21 from the concave surface 12 is controlled so that fluid is only projected from the holes 20 during an instant when a planar object, one example of which is a surfboard 22, passes over the holes 20. The fluid is projected from the holes via pressurized nozzles 23 which are positioned beneath holes 20 in the concave surface 12. Fluid is passed into the nozzles (now shown) via feeder pipes (not shown) which are positioned beneath the concave surface 12 and are substantially aligned with the longitudinal axis of the concave surface 12. Ends of the feeder pipes (now shown) are connected to a pressurized pipe 27 which is in turn connected to a pump 29. The pump 29 maintains the pressurized pipe 27 at a constant pressure such that when the nozzles 23 are opened pressurized fluid 21 is forced out of the open nozzles, through corresponding holes 20 in the concave surface 12 to be projected upwardly and away from the concave surface 12.

Opening and closing of the nozzles 23 which are located in the concave surface 12 is controlled by projection control means 33 which includes a sensor in the form of a primary photo electric proximity switch 31.

The primary proximity switch 31 controls the opening and closing of the nozzles 23 results in them opening for a period of time during which an underneath surface of the board or part of a person's body is positioned across holes 20 in the concave surface 12. Each of the nozzles 23 also has an associated shutoff mechanism which overrides the above-mentioned primary photo electric proximity switch.

The shutoff mechanism is capable of detecting when an object such as a surfboard, body board or person is on the concave surface 12 or very close to the concave surface 12. If the shutoff mechanism detects that an object or person is either on the concave surface 12 or very close to the conclave surface 12, the nozzles 23 are closed, regardless of what signal is being sent from the primary photo electric proximity switch 31. The shutoff mechanism therefore provides a safety mechanism that ensures fluid is not projected through openings 20 in the concave surface 12 and into delicate parts of a person's body such as their eyes. The shutoff mechanism is controlled by a secondary proximity switch (not shown) which is independent to the primary photo electric proximity switch 31. The secondary proximity switch is either a photo electric or ultra sonic proximity switch.

Figure 8:
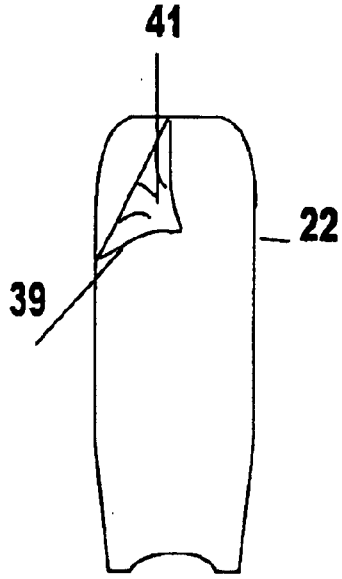
FIG. 8 is a plan view of the surfboard of FIG. 5 showing a coating which is attached to its bottom surface.

Referring to FIG. 8, the surfboard 22 includes an activating coating 39 which is attached to its bottom surface. The activating coating 39 includes material 41 which is designed to activate the primary photo electric proximity switches 31.

Nozzles 33 are also positioned within or beneath the take-off zone 14 which comprises an upper substantially horizontal platform 25 which extends rearwardly of an uppermost edge of the concave surface 12. The nozzles 33 which are positioned beneath the platform 25 are for projecting sheets of fluid 35 upwardly-through holes in the platform 25. The nozzles 33 are connected to the pump 29 and orientated relative to the platform 25 and concave surface 12 so that fluid is projected upwardly and outwardly relative to the concave surface 12 to simulate a wave commonly known as a tube or pipe line. The sheets of liquid 35 are only projected upwardly and forwardly of the uppermost edge of the concave surface 12 in a region along the longitudinal length of the concave surface 12 where a surfer is positioned at any given instant such that projected sheets of liquid 35 follow a surfer as the surfer moves along the length of the concave surface 12. Projection of the sheets of liquid 35 is coordinated by sheet projection coordination means 37. The sheet projection coordination means 37 includes sheet projection detection means in the form of primary photo electric proximity switch 31. In this way a surfer may enter and leave "pipes" or "tubes" created by the concave surface 12 and sheets of liquid projected from the platform 25, as a surfer moves along the length of the concave surface 12.

Before surfing the artificial wave 11, a surfer, body boarder or body surfer typically stands on the platform 25. Because the platform 25 extends along the longitudinal length of the concave surface 12 and is attached to an uppermost edge of the concave surface 12, a surfer, body boarder or body surfer can walk along the longitudinal length of the platform 25 to find a position along the longitudinal length of the concave surface 12 where they would like to begin their ride.

Referring to FIG. 5, the shape and surface area of longitudinal segments of the artificial wave 11 vary such that the arcuate length of adjacent arcuate concave subsegments of the concave surface 12 either increase or decrease relative to each other. The particular longitudinal segment of the concave surface 12 shown in FIG. 5 is formed of arcuate concave subsegments which generally increase in arcuate length the more closely they are positioned to a point which is approximately midway along the longitudinal length of the longitudinal segment of FIG. 5. From the left-hand side to the right-hand side of the longitudinal segment of FIG. 5, where the left- and the right-hand sides are relative to a person viewing the longitudinal segment of FIG. 5, the longitudinal segment of FIG. 5 generally comprises five different longitudinal segments namely, longitudinal segments 28, 30, 32, 34 and 36.

A lower edge of the concave surface 12 of each of the longitudinal segments 28–36 abuts an upper outside edge of the pool 16. The pool 16, when filled with fluid is essentially an elongated rectangular prism having a depth of approximately 1.5 m and_a width of approximately 3.5 m. The longitudinal axis of the pool 16 is substantially both straight and horizontal and extends in either direction so that its length is either equivalent to or greater than the longitudinal length of the lower edge of the concave surface 12. Because the arcuate length of arcuate concave subsegments which form each of the longitudinal segments 28–36 of the concave surface 12 vary and because the lower edge of the concave surface 12 meets an upper edge of the pool 16 whose longitudinal axis is substantially horizontal and straight, the longitudinal axis of the concave surface 12 is only aligned with the longitudinal axis of the pool 16 for those regions where the arcuate length of adjacent arcuate concave subsegments is constant. Referring to FIG. 5, the arcuate length of arcuate concave subsegments of the concave surface 12 is a maximum where longitudinal segments 30 and 32 meet. At this position the upper portion of the concave surface 12 extends upwardly and forwardly such that a surfer, body boarder or body surfer standing on the platform 25, as close to the pool 16 as possible would be standing over the concave surface 12 rather than behind the concave surface 12. If a person were to walk along the platform 25 toward the left-hand end of the longitudinal segment of FIG. 5, toward the longitudinal segment 28, they would be walking downhill and moving gradually closer to the longitudinal axis of the pool 16. This is because the arcuate length of arcuate concave subsegments which form the longitudinal segment 30 gradually decrease in moving from the right-hand end of the longitudinal segment 30 to the left-hand end of the longitudinal segment 30. It therefore follows that the longitudinal axis of the longitudinal segment 30 slopes downwardly toward the upper surface of the pool 16 and also inwardly toward the longitudinal axis of the pool 16 in moving from the right-hand end of the longitudinal segment 30 to the left-hand end of such a longitudinal segment. The upper portion of the concave surface 12 which is at the left-hand end of the longitudinal segment 30 is substantially upright such that a person standing on the platform 25 at the left-hand end of the longitudinal segment 30 and at the front of the platform 25 so that they are as close to the longitudinal axis of the pool 16 as possible stands over the rearmost portion of the concave surface 12. In moving from the right-hand end of the longitudinal segment 28 to its left-hand end the arcuate length of arcuate concave subsegments which form the longitudinal segment 28 gradually decrease. The upper portion of the concave surface 12, at the left-hand end of the longitudinal segment 28 extends upwardly and rearwardly of both the concave surface 12 and the longitudinal axis of the pool 16 such that a person standing on the platform 25 at a position corresponding to the left-hand end of the longitudinal segment 28 stands behind a rearmost portion of the concave surface 12.

The arcuate length of arcuate concave subsegments which form the longitudinal segment 32 decrease in moving from the left-hand end of the longitudinal segment 32 to the right-hand end of such a longitudinal segment to result in the longitudinal axis of the longitudinal segment 32 moving downwardly and forwardly toward the longitudinal axis of the pool 16. The longitudinal axis of the longitudinal segment 34 moves upwardly and away from the longitudinal axis of the pool 16 in moving from the left-hand end of the longitudinal segment 34 to the right-hand end of such a segment. The longitudinal axis of the longitudinal segment 36 moves downwardly and toward the longitudinal axis of the pool 16 in moving from the left-hand end of the longitudinal segment 36 to the right-hand end of such a segment.

The lowermost portion of the concave surface 12 curves so that the surface of the fluid which is within the pool 16 is essentially an extension of the lowermost portion of the concave surface 12.

Because the arcuate length of arcuate concave subsegments of the longitudinal segment of FIG. 5 vary, as previously mentioned, a surfer can move along the longitudinal length of the platform 25 until they are standing over a particular longitudinal segment (25–36) of the concave surface 12 that has a curvature which suits their surfing ability. The surfer then dismounts the platform 25 to contact the concave surface 12 therebelow and moves in a direction along the length of the concave surface 12 in a direction which is downwardly sloping to gradually increase their speed. For example, an experienced surfer may dismount the platform 25 at a position which is between the longitudinal segments 30_and 32 where the upper portion of the concave surface 12 extends upwardly and forwardly toward the pool 16, such that the surfer freefalls for a short period of time before coming into contact with the concave surface 12. Such a situation would simulate a surfer surfing a natural breaking ocean wave and positioning themselves on top of the_lip of the wave for a short period of time before moving off the lip and freefalling down to the face of the wave. Because the position between longitudinal segments 30 and 32 is the uppermost point of the longitudinal segment of FIG. 5, a surfer dismounting from such a position can either move toward the right-hand side of the longitudinal segment of FIG. 5 or the left-hand side of the longitudinal segment of FIG. 5 to move respectively along the longitudinal segment 32 or 30. After a surfer or body boarder has gathered speed by moving in a downward direction which is substantially aligned with a longitudinal axis of the concave surface 12, a surfer or body boarder can manoeuvre their board and a body surfer can manoeuvre themselves so as to move up the concave surface 12 toward the uppermost point of the concave surface 12 or down the concave surface 12 toward the pool 16.

The concave surface 12 is padded to absorb contact between a board, body board or person and the concave surface 12 to reduce the risk of injury when a surfer, body boarder or body surfer comes into contact with the concave surface 12.

What is claimed is:

1. A wave simulating device comprising:

a surface which substantially conforms to the shape that a face of a predetermined natural ocean wave has at a predetermined instant; and fluid projecting means for projecting fluid from a position which either lies in the plane of the surface or beneath said plane; wherein the fluid projecting means is arranged to project fluid out of the surface to enable a person to surf over the surface.

2. A wave simulating device as claimed in claim 1 wherein the fluid projecting means is arranged to project fluid out of the surface to enable a person to surf over the surface using a planar object including a body board, surf board or the like.

3. A wave simulating device as claimed in claim 1 wherein the fluid projecting means is arranged to fluid out of the surface to enable a person to body surf over the surface.

4. A wave simulating device as claimed in claim 1 wherein the fluid is completely or predominantly liquid.

5. A wave simulating device as claimed in claim 1 wherein the fluid projecting means comprises a plurality of nozzles.

6. A wave simulating device as claimed in claim 5 wherein the nozzles of the fluid projecting means are connected to fluid pressurizing means which is arranged to maintain fluid pressure so that upon opening of valves of the nozzles fluid is forced out of the nozzles and subsequently out of the surface.

7. A wave simulating device as claimed in claim 1 wherein the wave simulating device includes fluid projecting control means for controlling one or more characteristics of the projected fluid including:

a) pressure; and b) diffuseness.

8. A wave simulating device as claimed in claim 7 wherein the fluid projecting control means comprises fluid projecting detection means for detecting an instantaneous location of an object or person on the surface to enable fluid to be projected out of a corresponding fluid projecting location during the instant that a person or object passes over the instantaneous location.

9. A wave simulating device as claimed in claim 8 wherein the fluid projecting detection means comprises fluid projecting sensors which is are adapted to recognize an activating signal and subsequently activate the projection of fluid from one or more corresponding fluid projecting locations.

10. A wave simulating device as claimed in claim 9 wherein the fluid projecting sensors comprise proximity switches.

11. A wave simulating device as claimed in claim 10 wherein the proximity switches are selected from the group consisting of:

a) ultra sonic switches;

b) infra red switches; and c) photo-electric switches.

12. A wave simulating device as claimed in claim 9 wherein the activating signal comprises. movement of an object or person.

13. A wave simulating device as claimed in claim 12 wherein the activating signal comprises a material or coating which is attached to a bottom surface of a planar object, the skin of a person, or outside surface of a wetsuit worn by a person and is recognizable by one or more of the fluid projecting sensors.

14. A wave simulating device as claimed in claim 13 wherein the proximity switch includes a ferrous or non-ferrous metal detector.

15. A wave simulating device as claimed in claim 1 wherein a transverse section through the surface is partly annular, the surface extending a predetermined distance in a longitudinal direction to simulate a longitudinal segment of a predetermined natural breaking ocean wave.

16. A wave simulating device as claimed in claim 15 further comprising a plurality of longitudinal sub-segments that collectively correspond to the longitudinal segment, each longitudinal sub-segment having a longitudinal sub-segment axis that either slopes upwardly, downwardly, or is substantially horizontal, wherein the plurality of longitudinal sub-segments slopes generally downwardly.

17. A wave simulating device as claimed in claim 16 wherein the longitudinal sub-segments are arranged so that a person surfing over the surface moves either forwardly and downwardly, or upwardly and rearwardly of their instantaneous position as they surf along the length of a longitudinal sub-segment.

18. A wave simulating device as claimed in claim 16 further comprising a take-off region which extends along at least part of the length of a longitudinal sub-segment, proximal an upper region of the longitudinal sub-segment, the take-off region providing a region from where a person can to begin surfing over the surface.

19. A wave simulating device as claimed in claim 18 wherein the take-off region comprises a substantially horizontal platform.

20. A wave simulating device as claimed in claim 19 further comprising access means for access to the substantially horizontal platform.

21. A wave simulating device as claimed in claim 15 wherein the surface is adapted to cushion the impact between an object and/or person and the surface.

22. A wave simulating device as claimed in claim 21 wherein the surface is formed of a material which is arranged to reduce or minimize friction between an object and/or person and the surface.

23. A wave simulating device as claimed in claim 16 wherein a lower region of each longitudinal sub-segment extends downwardly toward a catchment pool having a predetermined depth of liquid for entry of a person after they have finished surfing over the surface.

24. A wave simulating device as claimed in claim 23 wherein the depth of liquid is equivalent to or greater than the depth of liquid required to break a person's fall.

25. A wave simulating device as claimed in claim 23 wherein an upper surface of liquid in the catchment pool forms an extension of a lower edge of each longitudinal sub-segment.

26. A wave simulating device as claimed claim 15, wherein the transverse section through the surface is substantially semi-annular.

27. A wave simulating device as claimed in claim 1 further comprising sheet projecting means for projecting sheets of liquid from an upper region of said surface, upwardly and forwardly thereof, to simulate a predetermined natural breaking ocean wave commonly referred to as a pipeline or tube.

28. A wave simulating device as claimed in claim 27 further comprising sheet projection coordination means for coordinating the projection of sheets of liquid from the surface with the position of a person surfing over the surface so the person surfs in simulated "pipes" or "tubes".

29. A wave simulating device as claimed in claim 28 wherein the sheet projection coordination means comprises sheet projection detection means for detecting an instantaneous location of a person surfing over the surface.

30. A wave simulating device as claimed in claim 29 wherein the sheet projection detection means comprises sheet projection sensors which are arranged to sense a person surfing over the surface when they are within a predetermined distance of the sensor.

31. A wave simulating device as claimed in claim 30 wherein the sheet projection sensors are arranged to sense a material or coating which is attached to a bottom side of a planar object, the skin of a person, or outside surface of a wetsuit worn by a person.

32. A wave simulating device as claimed in claim 31 wherein the sheet projection sensors comprise a ferrous or non-ferrous metal detector.

33. A wave simulating device as claimed in claim 30 wherein the sheet projection sensors comprise sheet projection proximity switches.

34. A wave simulating device as claimed in claim 33 wherein the sheet projection proximity switches are selected from the group consisting of:

a) ultra sonic switches;

b) infrared switches; and c) photo-electric switches.

35. A wave simulating device as claimed in claim 27 wherein the sheet projection means is connected to other fluid pressurizing means which is arranged to maintain fluid pressure so that upon opening of valves of said sheet projecting means fluid is forced out of the sheet projection means.

36. A wave simulating device as claimed in claim 1 further comprising support means for supporting the surface.

37. A wave simulating device as claimed in claim 1 wherein the fluid projecting means is arranged to project fluid from a plurality of fluid projecting locations.

38. A wave simulating device as claimed in claim 37 wherein the fluid projecting means is arranged to project fluid substantially normally of regions of the surface which are proximal the fluid projecting locations.

39. A wave simulating device as claimed in claim 37 further comprising fluid projecting control means for controlling the projection of fluid from the fluid projecting locations so that it is only projected while a person or object is positioned in the pathway of the projected fluid.

40. A wave simulating device as claimed in claim 39 wherein the fluid projecting control means controls the projection of fluid so that it is only projected while a person or object is proximal the surface.

41. A method of simulating a predetermined natural ocean wave comprising the steps of:

a) providing a surface which substantially conforms to the shape that a face of a predetermined natural ocean wave has at a predetermined instant; and b) projecting fluid, from a position which either lies in the plane of the surface or beneath said plane, out of the surface to enable a person to surf over the surface.

42. A method of simulating a predetermined natural ocean wave as claimed in claim 41 wherein the step of projecting fluid out of the surface comprises projection of fluid from a plurality of fluid projecting locations.

43. A method of simulating a predetermined natural ocean wave as claimed in claim 42 further comprising projection of fluid substantially normally of regions of the surface which are proximal the fluid projecting locations.

44. A method of simulating a predetermined natural ocean wave as claimed in claim 42 or claim 43 wherein the projection of fluid from the fluid projecting locations is controlled so that it is only projected while a person or object is positioned in the pathway of the projected fluid.

45. A method of simulating a predetermined natural ocean wave as claimed in claim 44 wherein the projection of fluid from the fluid projecting locations is further controlled so that it is only projected while a person or object is proximal the surface.

46. A method of simulating surfing of a predetermined natural ocean wave comprising the steps of:

a) providing a surface which substantially conforms to the shape that a face of a predetermined natural ocean wave has at a predetermined instant;

b) projecting fluid, from a position which either lies in the plane of the surface or beneath said plane, out of the surface to enable a person to surf over the surface; and c) surfing over the surface on said fluid projected therefrom.

47. A method of simulating surfing of a predetermined natural ocean wave as claimed in claim 46 wherein the step of projecting fluid out of the surface comprises projection of fluid from a plurality of fluid projecting locations.

48. A method of simulating surfing of a predetermined natural ocean wave as claimed in claim 47 further comprising projection of fluid substantially normally of regions of the surface which are proximal the fluid projecting locations.

49. A method of simulating surfing of a predetermined natural ocean wave as claimed in claim 47 or 48 wherein the projection of fluid from the fluid projecting locations is controlled so that it is only projected while a person or object is positioned in the pathway of the projected fluid.

50. A method of simulating surfing of a predetermined natural ocean wave as claimed in claim 49 wherein the projection of fluid from the fluid projecting locations is further controlled so that it is only projected while a person or object is proximal the surface.

51. A wave simulating device comprising:

a surface which substantially conforms to the shape that a face of a predetermined natural ocean wave has at a predetermined instant; and fluid projecting means arranged to project fluid out of the surface from a plurality of fluid projecting locations which either lie in the plane of the surface or beneath said plane to enable a person to surf over the surface; wherein the fluid projecting means is arranged to project fluid substantially normally of regions of the surface which are proximal the fluid projecting locations.

52. A wave simulating device as claimed in claim 51 further comprising sheet projecting means for projecting sheets of liquid from an upper region of said surface, upwardly and forwardly thereof, to simulate a predetermined natural breaking ocean wave commonly referred to as a pipeline or tube.

53. A wave simulating device comprising:

a surface which substantially conforms to the shape that a face of a predetermined natural ocean wave has at a predetermined instant;

fluid projecting means arranged to project fluid out of the surface from a position which either lie in the plane of the surface or beneath said plane to enable a person to surf over the surface; and sheet projecting means for projecting sheets of liquid from an upper region of said surface, upwardly and forwardly thereof, to simulate a predetermined natural breaking ocean wave commonly referred to as a pipeline or tube.

54. A wave simulating device as claimed in claim 53 further comprising sheet projection coordination means for coordinating the projection of sheets of liquid from the surface with the position of a person surfing over the surface so the person surfs in simulated "pipes" or "tubes".

55. A wave simulating device as claimed in claim 54 wherein the sheet projection coordination means comprises sheet projection detection means for detecting an instantaneous location of a person surfing over the surface.

56. A wave simulating device as claimed in claim 55 wherein the sheet projection detection means sheet projection sensors which are arranged to sense a person surfing over the surface when they are within a predetermined distance of the sensor.

57. A wave simulating device as claimed in claim 56 wherein the sheet projection sensors are arranged to sense a material or coating which is attached to a bottom side of a planar object, the skin of a person, or outside surface of a wetsuit worn by a person.

58. A wave simulating device as claimed in claim 57 wherein the sheet projection sensors comprise ferrous or non-ferrous metal detectors.

59. A wave simulating device as claimed in claim 56 wherein the sheet projection sensors comprise sheet projection proximity switches.

60. A wave simulating device as claimed in claim 59 wherein the sheet projection proximity switches are selected from the group consisting of:

a) ultra sonic switches;

b) infrared switches; and c) photo-electric switches.

61. A wave simulating device as claimed in claim 53 wherein the sheet projection means is connected to fluid pressurizing means which is arranged to maintain fluid pressure so that upon opening of valves of said sheet projecting means fluid is forced out of the sheet projection means.

62. A method of simulating a predetermined natural ocean wave comprising the steps of:

a) providing a surface which substantially conforms to the shape that a face of a predetermined natural ocean wave has at a predetermined instant; and b) projecting fluid from a plurality of fluid projecting locations which either lie in the plane of the surface or beneath said plane, substantially normally of regions of the surface which are proximal the fluid projecting locations, to enable a person to surf over the surface.

63. A method of simulating surfing of a predetermined natural ocean wave comprising the steps of:

a) providing a surface which substantially conforms to the shape that a face of a predetermined natural ocean wave has at a predetermined instant;

b) projecting fluid from a plurality of fluid projecting locations which either lie in the plane of the surface or beneath said plane, substantially normally of regions of the surface which are proximal the fluid projecting locations, to enable a person to surf over the surface; and c) surfing over the surface on said fluid projected therefrom.

* * * * *